United States Patent [19]

Goodrich

[11] 4,424,501

[45] Jan. 3, 1984

[54] ELECTROMAGNETIC CONTACTOR HAVING IMPROVED CONTACT STRUCTURE

[75] Inventor: Ronald W. Goodrich, Logansport, Ind.

[73] Assignee: Essex Group, Inc., Fort Wayne, Ind.

[21] Appl. No.: 375,598

[22] Filed: May 6, 1982

Related U.S. Application Data

[63] Continuation-in-part of Ser. No. 371,107, Apr. 19, 1982.

[51] Int. Cl.[3] ..... H01H 3/60; H01H 51/08

[52] U.S. Cl. ..... 335/193; 335/135; 335/46

[58] Field of Search ..... 335/193, 46, 104, 247, 335/271, 128, 135

[56] References Cited

U.S. PATENT DOCUMENTS

| | | | |
|---|---|---|---|
| 2,638,514 | 5/1953 | Martin | 200/1 |
| 3,014,103 | 2/1961 | Moran et al. | 335/193 |
| 3,243,546 | 7/1966 | Woods | 335/193 |
| 3,293,398 | 12/1966 | Larsh | 200/165 |
| 4,199,740 | 4/1980 | Woods | 335/202 |

*Primary Examiner*—Harold Broome

*Attorney, Agent, or Firm*—Robert D. Sommer

[57] ABSTRACT

An electromagnetic contactor having an improved contact structure comprising a cantilever mounted contact leaf spring with the free end portion thereof longitudinally slotted into three tongues, the center one of which is bent at an obtuse angle to serve as an overtravel spring. The free end of the contact leaf spring is engaged with a linearly reciprocating actuator which flexes the center tongue toward the outer tongues upon engagement of a fixed contact by a movable contact carried by the contact leaf spring to damp contact bounce.

1 Claim, 2 Drawing Figures

100
80
102
72
70
100
68
82
104

56
52
58
64
68
100
80
72
100
62
70
66
42
82
76
46
74
54
50
60
58
106
106
88
88
98
96
44
34
28
30
84
86

24
38
78
36
32
22
48
40
18
12
16
20
14

ELECTROMAGNETIC CONTACTOR HAVING IMPROVED CONTACT STRUCTURE

CROSS REFERENCE TO RELATED APPLICATION

This application is a continuation-in-part of my co-pending application Ser. No. 371,107 entitled "ELECTROMAGNETIC CONTACTOR" and executed Apr. 19, 1982.

BACKGROUND OF THE INVENTION

This invention relates to electromagnetic contactors and more particularly to an improved contact structure for small, low cost electromagnetic contactors of the type used in air conditioning and heating systems.

Small low cost electromagnetic contactors of the type disclosed in the Moran et al U.S. Pat. No. 3,014,103 issued Dec. 19, 1961, the Woods U.S. Pat. No. 3,243,546 issued Mar. 29, 1966, and the Woods U.S. Pat. No. 4,199,740 issued Apr. 22, 1980 are commonly employed in air conditioning and heating systems. In such contactors, a contact actuator is slidably guided in a terminal and contact block and engages the free end of a contact leaf spring which is mounted cantilever fashion on the block and carries a movable contact engageable with a fixed contact on the block. The contact actuator actuates the contact leaf spring to a closed contact position through a bias spring which is stressed further upon overtravel of the contact actuator following initial closing of the contacts. As explained in the aforesaid U.S. Pat. Nos. 3,014,103 and 3,243,546, the entire disclosures of which are incorporated herein by reference, the overtravel of the contact actuator to its final position compresses the bias spring against the contact leaf spring, thereby pressing the contacts together and damping contact bounce.

In the contactors of the aforesaid U.S. patents, the biasing spring is in the form of a coiled compression spring or a waved leaf spring which must be assembled in trapped relation with the contact leaf spring and the actuator. For use in other types of electric switches, it has also been proposed to rivet or weld a bias spring in the form of a leaf spring to a contact leaf spring as shown, for example, in the Martin U.S. Pat. No. 2,638,514 issued May 12, 1953 and the Larsh U.S. Pat. No. 3,293,398 issued Dec. 20, 1966. In the high quantity manufacture of small low cost electromagnetic contactors, it is increasingly important to minimize the number of parts, the number of assembly operations and the amount of manual labor involved in order to reduce the cost of manufacture. The present invention is directed to an improved contact leaf spring and bias spring arrangement which will result in a substantial reduction in manufacturing cost.

SUMMARY OF THE INVENTION

According to the present invention, there is provided an improvement in the electromagnetic contactor of the type disclosed in the aforesaid U.S. Pat. Nos. 3,014,103 and 3,243,546 in which a single cantilever mounted contact leaf spring with upstanding stiffening side flanges along its sides has a free end portion longitudinally slotted into three tongues. The outer tongues lie substantially in the major plane of the contact leaf spring and the center tongue is bent at an obtuse angle from the major plane of the contact leaf spring. The free end of the contact leaf spring projects into an aperture formed in a linearly reciprocating contact actuator and defining opposing parallel abutments normal to the path traveled by the contact actuator. The center tongue is in resilient engagement with one of the abutments and biases the outer tongues into engagement with the other abutment. A movable contact carried by the contact leaf spring intermediate the ends thereof engages a fixed contact before movement of the contact actuator from an at-rest position to an actuated position is completed thereby flexing the center tongue toward the outer tongues for damping contact bounce.

For a better understanding of the invention, reference may be had to the following detailed description taken in connection with the accompanying drawing, in which:

DETAILED DESCRIPTION OF THE INVENTION

Figures 1, 2:
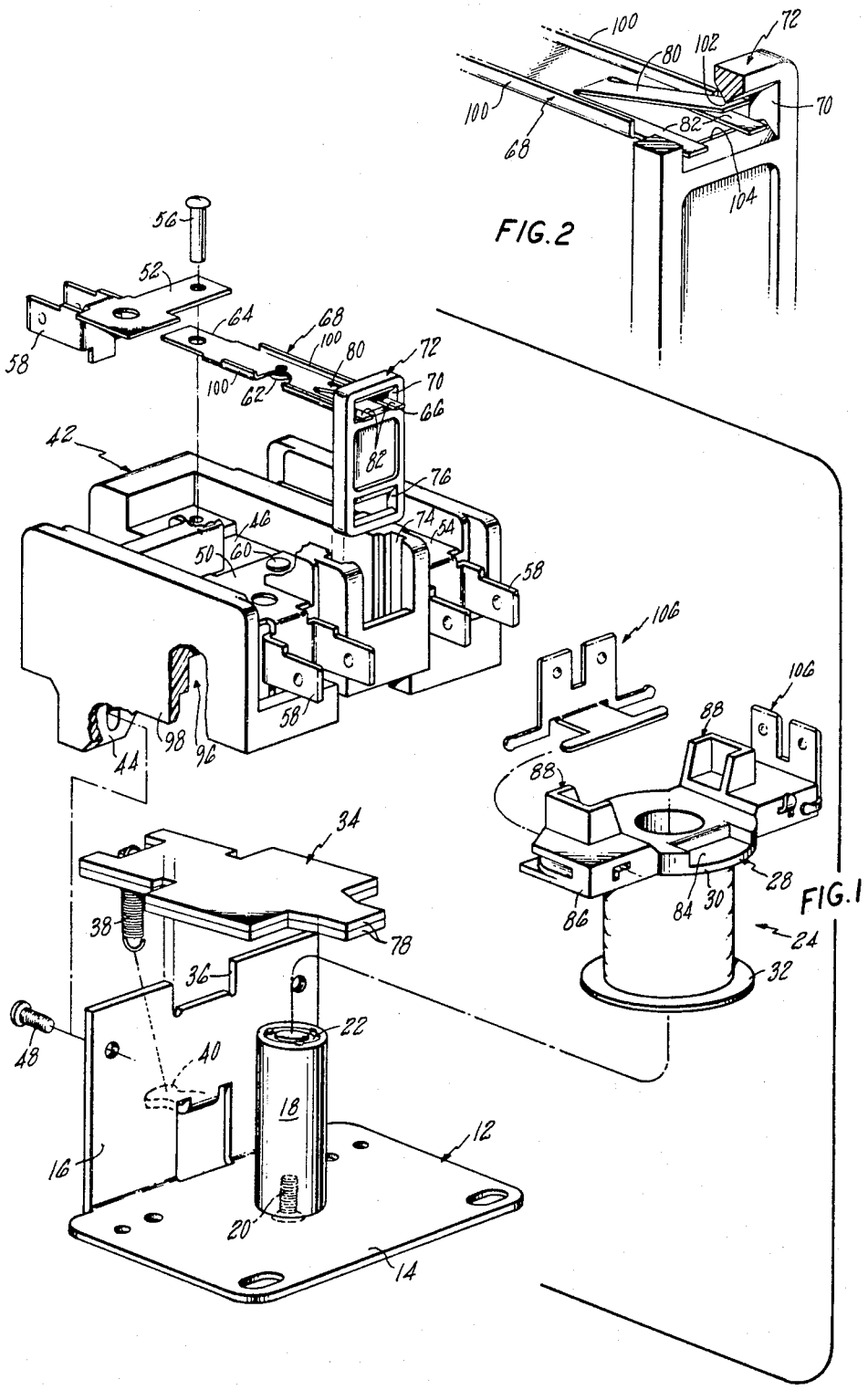
FIG. 1 is an exploded perspective view of an electromagnetic contactor according to the present invention.
FIG. 2 is an enlarged perspective cutaway view showing the contact leaf spring and the contact actuator of the electromagnetic contactor of FIG. 1.

Referring now to the drawing, an electromagnetic contactor 10 in accordance with the present invention includes a frame 12 formed from a ferromagnetic material and having a base portion 14 and a leg portion 16 bent at right angles to each other. A cylindrical core 18 of ferromagnetic material is secured to one end to the frame base portion 14 by connection means such as a screw 20 and may have a conventional shading ring 22 embedded in its other end. The core 18 carries a coil assembly 24 which includes an electrical coil 26 wound about a bobbin 28 molded of nylon or other suitable insulation material between the end flanges 30 and 32 of the bobbin. A laminated armature 34 extending through an opening 36 provided in the frame leg portion 16 is pivotally supported thereon in a conventional manner for movement toward and away from the core 18. The armature 34 is normally biased away from the core 18 by a tension spring 38 connected between one end of the armature and a lug 40 lanced out of the frame leg portion 16.

The specific construction of the coil assembly 24 including the support arms 86 and the upstanding projections 88 of the bobbin 28 and the terminals 106 form no part of the present invention and accordingly will not be described. However, reference may be had to my aforesaid co-pending application for a detailed description of the coil assembly 24.

A terminal and contact block 42 molded of a phenolic resin or other suitable insulation material is mounted on the frame leg portion 16. The block 42 has two foot portions 44 extending at substantially right angles from a platform portion 46 and secured directly to the frame leg portion 16 by the screws 48. Three terminal members 50, 52 and 54 are secured to the upper face of the block platform portion 46 by suitable means such as the rivets 56 and may be provided with tabs 58 or other appropriate means to which electrical connections may be made.

A contact actuator 72 of glass filled nylon or other suitable insulating material is slidably mounted for linear reciprocation in a slot-like guide opening 74 extending through the platform portion 46 of the block 42. At its lower end, the actuator 72 has an aperture 76 which receives in driving engagement the tongues 78 at one end of the armature 34. The armature 34 together with the frame 12, the core 18 and the coil assembly 24 comprise an electromagnetic operator for reciprocating the actuator 72 in a path determined by the guide opening 74. The end of the armature 34 in engagement with the actuator 72 is normally urged upwardly to an at-rest position with the armature 34 abutting a lower stop surface of the platform portion 46. Upon energization of the coil 26, the armature 34 is magnetically attracted downwardly to an actuated position in engagement with the core 18. The upper face of the bobbin flange 30 may be recessed at 84 to accommodate the lower end of the actuator 72 in the actuated position of the actuator 72.

A stationary or fixed contact 60 is mounted on the terminal member 50 for engagement by a movable contact 62 that is carried intermediate the ends 64 and 66 of a contact leaf spring 68. The contact leaf spring 68 is formed of a suitable conductive spring material such as beryllium copper and has upstanding stiffening side flanges 100 along the sides thereof extending along a major length of the contact leaf spring 68. The contact leaf spring 68 is mounted in cantilever fashion on the platform portion 46 with one end 64 welded to the lower side of the terminal member 54 and the other end projecting into an aperture 70 formed in the upper end of the actuator 72. As best seen in FIG. 2, the aperture 70 defines upper and lower knife edge abutments 102 and 104 normal to the path traveled by the actuator 72.

In accordance with the present invention, the end portion of the contact leaf spring 68 at the free end 66 is longitudinally slotted into three tongues 80 and 82. The outer tongues 82 lie substantially in the major plane of the contact leaf spring 68 and the center tongue 80 is upwardly bent at an obtuse angle from the major plane of the contact leaf spring 68. In preferred embodiment of the invention illustrated in the drawing, the contact leaf spring is formed of beryllium copper about 0.2 mm. thick with an overall length of about 41 mm. and a width of about 7.6 mm. The center tongue 80 has a length of about 13 mm. and extends at an angle of about 15° relative to the outer tongues 82 in its free unstressed state. With the end 66 of the contact leaf spring 68 projecting into the aperture 70 between the abutments 102 and 104, the center tongue 80 is stressed into resilient engagement with the upper abutment 102 and biases the outer tongues 82 into engagement with the lower abutment 104.

In operation of the contactor 10, the actuator 72 is normally in its at-rest position with the movable contact 62 on the contact leaf spring 68 separated from the fixed contact 60. Upon energization of the coil 26, the armature 34 is attracted to the core 18 and begins to pivot downwardly during the initial downward movement of the actuator 72 causing the portion of the contact leaf spring 68 between its fixed end 64 and the adjacent ends of the side flanges 100 to flex until the movable contact 62 engages the fixed contact 60. The downward movement of the movable contact 62 and the outer tongues 82 is terminated upon this contact engagement which occurs before the travel of the actuator 72 to its actuated position is completed. The travel of the actuator 72 following contact engagement flexes the center tongue 80 downwardly toward the outer tongues 82 thus providing an increasing spring biasing force to the contact leaf spring 68 which tends to prevent or damp any contact bounce. In the actuated position of the actuator 72, the stressed center tongue 80 assured firm pressure of the movable contact 62 against the fixed contact 60. It is apparent, therefore, that the beneficial contact bounce damping action such as heretofore provided by a separate biasing spring is obtained with a simple and low cost improvement in the structure of the contact leaf spring 68 which results in a significant reduction in manufacturing cost.

While there has been described above the principles of this invention in connection with a specific contactor construction, it is to be understood that this description is made only by way of example and not as a limitation to the scope of the invention.

What is claimed is:

1. An electromagnetic contactor comprising: a terminal and contact block of insulating material having a slot-like guide opening therethrough; a contact actuator of insulating material slidably received in said guide opening for linear reciprocation in a path determined by said guide opening; said actuator having an aperture therein defining opposing parallel abutments normal to said path; a contact leaf spring mounted in cantilever fashion on said block with the free end of said leaf spring projecting into said aperture between said abutments; said leaf spring having upstanding stiffening side flanges along the sides thereof extending along a major length of said leaf spring; the free end portion of said leaf spring being longitudinally slotted into three tongues; the outer tongues lying substantially in the major plane of said leaf spring and the center tongue being bent at an obtuse angle from the major plan of said leaf spring; said center tongue being in resilient engagement with one of said abutments and biasing said outer tongues into engagement with the other of said abutments; a movable contact carried by said leaf spring intermediate the ends thereof; a fixed contact on said block engageable by said movable contact; and an electromagnetic operator for moving said actuator along said path from an at-rest position to an actuated position for closing said contact; said movable contact engaging said fixed contact before movement of said actuator to its actuated position thereby flexing said center tongue toward said outer tongues for damping contact bounce.

* * * * *